US008465026B1

(12) United States Patent
Yeh

(10) Patent No.: US 8,465,026 B1
(45) Date of Patent: Jun. 18, 2013

(54) SAFE ROLLER SHOE STRUCTURE

(76) Inventor: Ching-Ho Yeh, Taichung (TW)

( * ) Notice: Subject to any disclaimer, the term of this patent is extended or adjusted under 35 U.S.C. 154(b) by 0 days.

(21) Appl. No.: 13/492,953

(22) Filed: Jun. 11, 2012

(51) Int. Cl.
*A63C 17/00* (2006.01)

(52) U.S. Cl.
USPC ..... 280/11.19; 280/11.231

(58) Field of Classification Search
USPC ..... 280/7.13, 7.15, 841, 11.115, 11.19, 280/11.221, 11.223, 11.231
See application file for complete search history.

(56) References Cited

U.S. PATENT DOCUMENTS

| | | | | |
|---|---|---|---|---|
| 4,523,767 | A * | 6/1985 | Le Page | 280/11.19 |
| 5,224,718 | A * | 7/1993 | Gertler | 280/11.19 |
| 5,421,596 | A * | 6/1995 | Lee | 280/11.19 |
| 2002/0158429 | A1 * | 10/2002 | Saylor | 280/11.231 |

* cited by examiner

*Primary Examiner* — John Walters
*Assistant Examiner* — James Triggs

(57) ABSTRACT

A safe roller shoe structure contains a body and a base, the base includes four rollers, characterized in that a pedal is lower than an upper periphery of each roller to lower a gravity center of legs in exercise; the pedal includes the four seats four integrally formed and extending from two sides thereof to correspond to the four rollers.

2 Claims, 5 Drawing Sheets

SAFE ROLLER SHOE STRUCTURE

FIELD OF THE INVENTION

The present invention relates to roller skates, and more particularly to a safe roller shoe structure.

BACKGROUND OF THE INVENTION

A conventional roller shoe structure has the following features:

1. A height of a gravity of a roller shoe is higher than an upper periphery of roller.

2. The roller shoe has to fix a base connected with a body.

However, a gravity center of the user's legs is enhance highly that will hurt the ankle easily. In other words, the higher the gravity center of the roller shoe is, the stronger reflex muscle strength and joint torsional toughness is, thus injuring the legs.

In addition, a separate base is connected with the body of the roller shoe, thus having complicated structure and increasing production cost and operation unsafely.

SUMMARY OF THE INVENTION

The primary object of the present invention is to provide a safe roller shoe structure which decrease a gravity center of a user's legs in exercise to prevent from an injure.

Another object of the present invention is to provide the safe roller shoe structure which obtains a predetermined low gravity-center height and simplify the roller shoe structure.

In accordance with a preferred embodiment of the present invention, a safe roller shoe structure contains:

a body and a base, the base includes four rollers, characterized in that a pedal is lower than an upper periphery of each roller to lower a gravity center of legs in exercise;

the pedal includes the four seats four integrally formed and extending from two sides thereof to correspond to the four rollers.

A rate of a diameter of two rollers fixed on two front ends of two sides of the base against that of another two rollers fixed on two rear ends of the two sides of the base is 1:2.

When a diameter height of the two small-diameter rollers is less than a gravity-center height of a pedal, a width of the two small-diameter rollers is decreased, and a radian of the two small-diameter rollers is less than the gravity-center height of the pedal.

If a height of a gravity center of the pedal is more than a height of an axial line of two large-diameter rollers which are fixed on the two rear ends of the two sides of the base, a shaft of each roller is capable of forming the seat by using a thickness of the pedal, so that two corresponding abreast rollers are capable of sharing the shaft inserted through the two abreast rollers.

The two small-diameter rollers are capable of simplified to form a single roller.

Thereby, because the pedal is lower than the upper periphery of the roller or even the shaft, a gravity center of the user legs is decreased greatly to prevent from an injure.

DETAILED DESCRIPTION OF THE PREFERRED EMBODIMENTS

Figure 1:
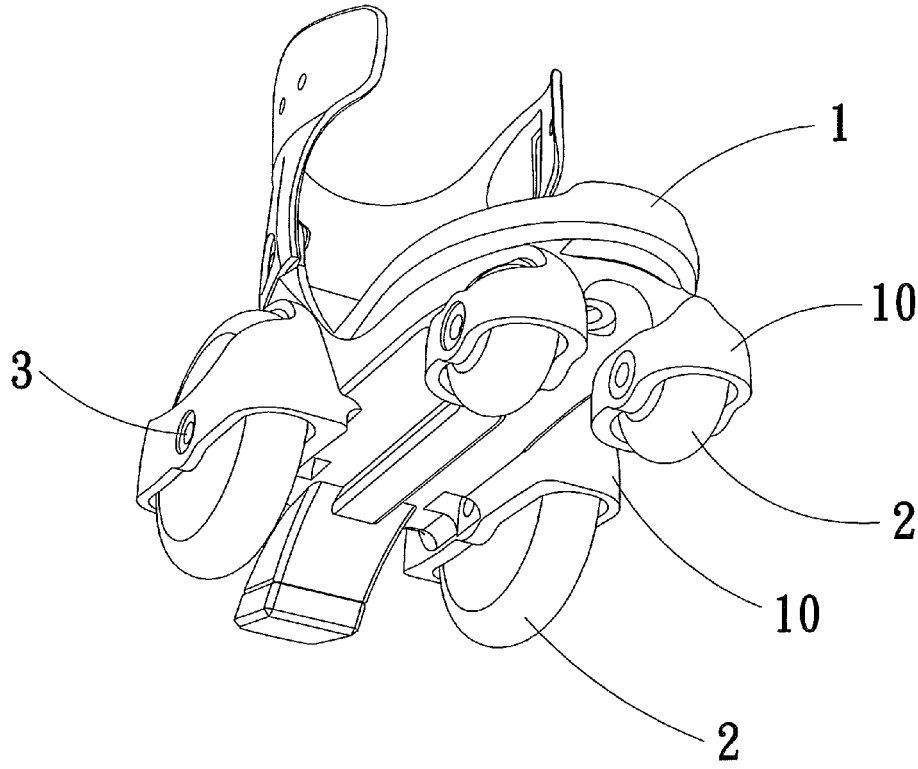
FIG. 1 is a perspective view showing the assembly of a safe roller shoe structure according to a preferred embodiment of the present invention.
Figure 2:
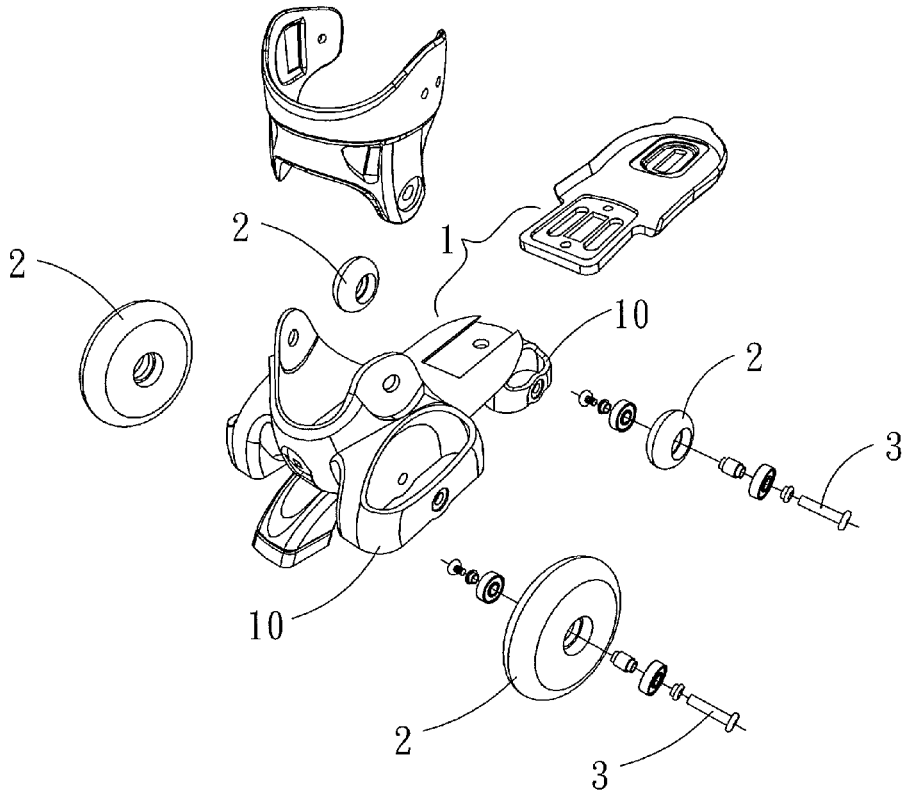
FIG. 2 is a perspective view showing the exploded components of the safe roller shoe structure according to the preferred embodiment of the present invention.
Figure 3:
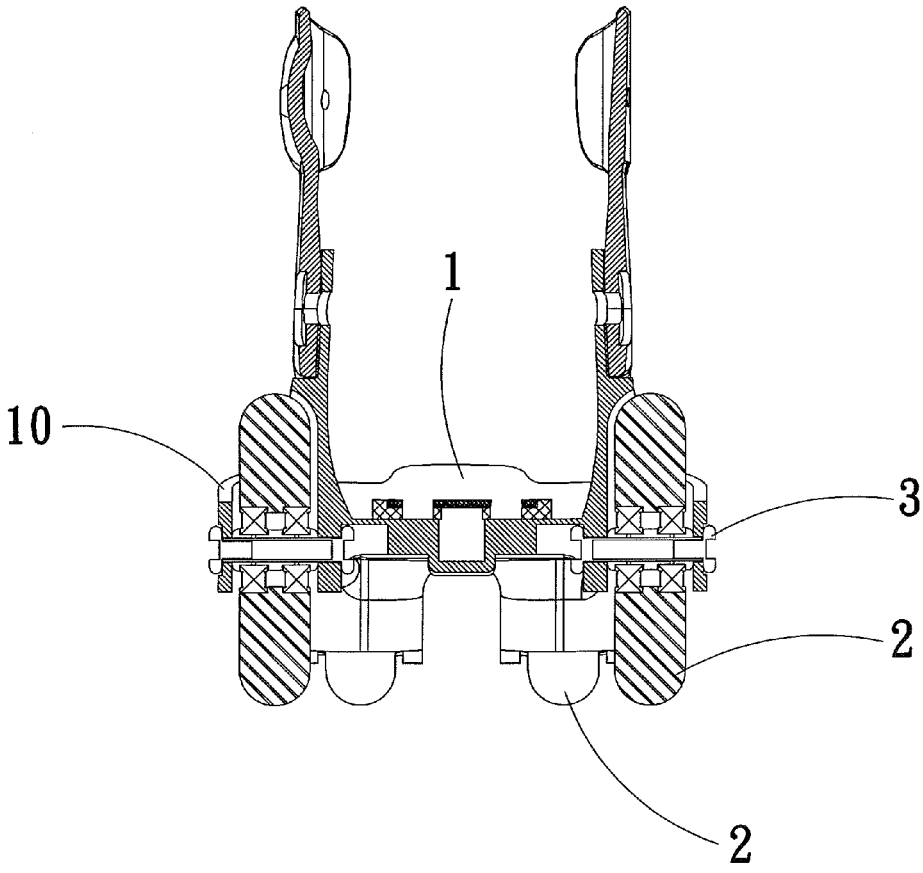
FIG. 3 is a cross sectional view showing the assembly of the safe roller shoe structure according to the preferred embodiment of the present invention.
Figure 4:
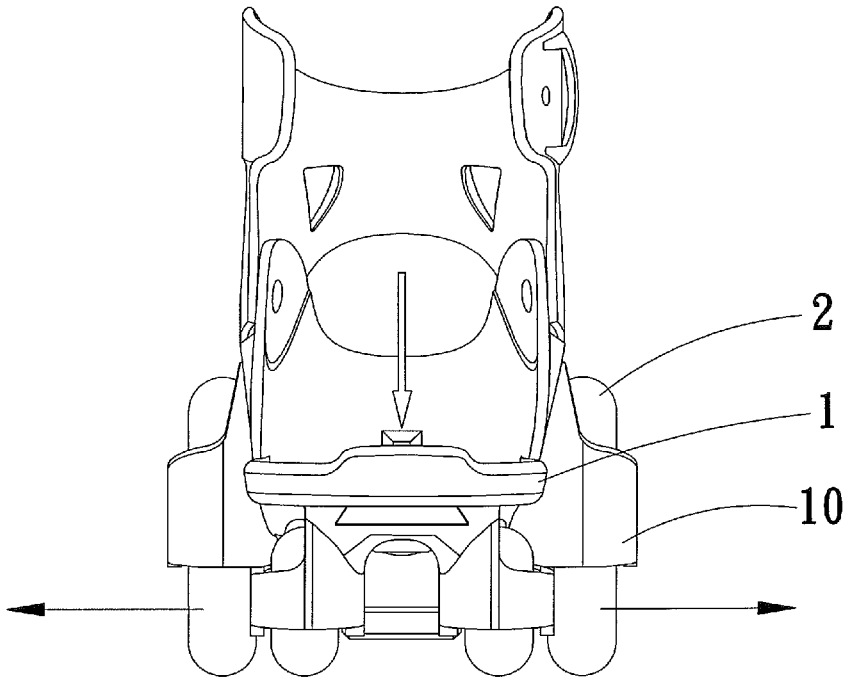
FIG. 4 is a front plan view showing the assembly of the safe roller shoe structure according to the preferred embodiment of the present invention.

FIG. 1 is a perspective view showing the assembly of a safe roller shoe structure according to a preferred embodiment of the present invention. FIG. 2 is a perspective view showing the exploded components of the safe roller shoe structure according to the preferred embodiment of the present invention. FIG. 3 is a cross sectional view showing the assembly of the safe roller shoe structure according to the preferred embodiment of the present invention. FIG. 4 is a front plan view showing the assembly of the safe roller shoe structure according to the preferred embodiment of the present invention.

The safe roller shoe structure of the present invention comprises a body and a base, the base includes four rollers 2, wherein a height range of an upper periphery of each roller 2 is capable of being less than a height of each shaft 3, thereby decreasing a gravity center of a user's legs in exercise.

Furthermore, the pedal 1 includes four integrally formed seats 10 extending from two sides thereof to correspond to the four rollers 2. An angle, at which each roller is fixed, determines a height of a gravity center of the pedal 1, thus obtaining a predetermined low gravity-center height and simplifying the roller shoe structure.

The roller shoe structure includes the four rollers 2, and two of the four rollers 2 are fixed on two front ends of the two sides of the base, another two of the four rollers 2 are fixed on two rear ends of the two sides of the base, wherein the two rollers 2 correspond to the another two rollers 2, and a rate of a diameter of the two rollers 2 against that of the another two rollers 2 is 1:2, the diameter of the two rollers 2 and the another rollers 2 is increased or decreased 10%.

Figure 5:
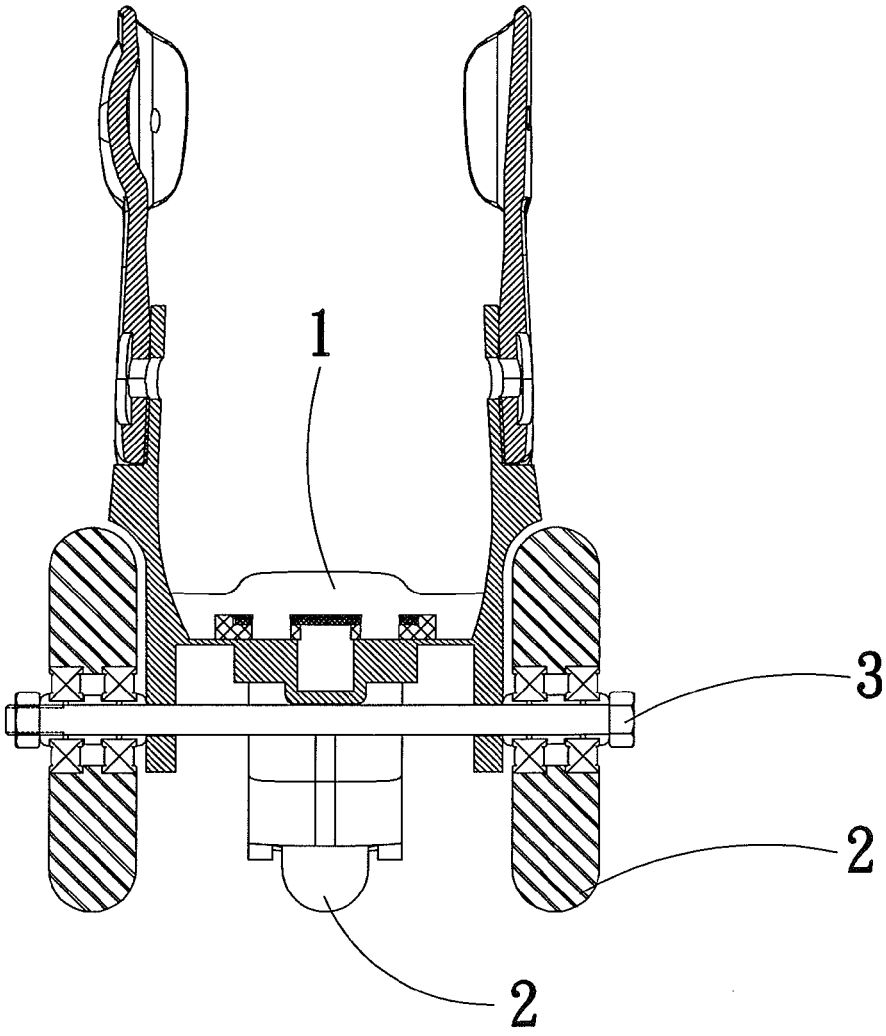
FIG. 5 is a perspective view showing the exploded components of a safe roller shoe structure according to another preferred embodiment of the present invention.

Referring to FIG. 5, a safe roller shoe structure of another embodiment of the present invention includes two small-diameter rollers 2 fixed on two front ends of two sides of the base, when a diameter height of the two small-diameter rollers 2 is less than a gravity-center height of a pedal 1, a width of the two small-diameter rollers 2 is decreased, and a radian of the two small-diameter rollers 2 is slightly less than the gravity-center height of the pedal 1, the two small-diameter rollers 2 are capable of simplified to form a single roller 2 as a nose wheel of a three-wheel arrangement of an airplane.

Also, a safe roller shoe structure of another embodiment of the present invention as illustrated in FIG. 5, if a height of a gravity center of the pedal 1 is more than a height of an axial line of two large-diameter rollers which are fixed on two rear ends of the two sides of the base, a shaft 3 of each roller 2 is capable of forming a seat 10 by using a thickness of the pedal 1 so that two corresponding abreast rollers 2 are capable of sharing the shaft 3 inserted through the two abreast rollers 2, thus simplifying the seat 10.

Thereby, because the pedal is lower than the upper periphery of the roller or even the shaft, a gravity center of the user legs is decreased greatly to prevent from an injure.

In addition, the pedal 1 includes the four integrally formed seats 10 extending from the two sides thereof to correspond to the four rollers 2, so the four seats 10 are simplified.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A safe roller shoe structure comprising:

a body including a pedal;

a base including four rollers, two of which are fixed on two front ends of two sides of the base, and the other two of which are fixed on two rear ends of the two sides of the base;

the pedal including four integrally formed seats extending from two sides thereof so as to correspond to and to receive the four rollers;

a shaft used to insert through each roller and each seat so as to position the each roller in the each seat; characterized in that a height of the pedal of the body is lower than a height of two rollers which are fixed on the two rear ends of the two sides of the base, thereby decreasing a gravity center of a user's legs in exercise;

a rate of a diameter of two rollers on the two front ends of the base against that of the two rollers on the two rear ends of the base is 1:2;

a range to increase or decrease a diameter of the four rollers is 15%.

2. A safe roller shoe structure comprising:

a body including a pedal;

a base including three rollers, one of which has a small diameter and is fixed on a center of two front ends of two sides of the base, and the other two of which have a large diameter and are mounted on two rear ends of the two sides of the base;

the pedal including at least two seats to correspond to and to receive the three rollers;

at least two shafts used to insert through the three rollers and each seat so as to position each roller in the each seat; characterized in that a rate of a diameter of a roller on the center of the two front ends of the base against that of two rollers on the two rear ends of the base is 1:2;

a range to increase or decrease a diameter of the each roller is 15%;

a diameter height of the roller is less than a gravity-center height of the pedal;

a height of a gravity center of the pedal is more than a height of an axial line of the two rollers;

a single shaft of the two rollers is used as a seat for fixing the two rollers by ways of a thickness of the pedal so that the two rollers are fixed by the single shaft, thus simplifying the at least two seats.

* * * * *